United States Patent [19]

Miles

[11] Patent Number: 4,695,100

[45] Date of Patent: Sep. 22, 1987

[54] VALVE SYSTEM FOR EXERCISE APPARATUS

[75] Inventor: James E. Miles, Graham, N.C.

[73] Assignee: Isotechnologies, Inc., Hillsborough, N.C.

[21] Appl. No.: 820,717

[22] Filed: Jan. 17, 1986

[51] Int. Cl.[4] ..... B60T 13/18

[52] U.S. Cl. ..... 303/10; 188/290; 417/307

[58] Field of Search ..... 188/290, 293, 294; 303/10, 11; 417/282, 283, 301, 302, 303, 307, 308; 60/462, 463, 464, 468

[56] References Cited

U.S. PATENT DOCUMENTS

| | | | |
|---|---|---|---|
| 2,551,677 | 5/1951 | Hoffstrom | 188/290 X |
| 2,665,552 | 1/1954 | Deardorff | 60/462 |
| 2,946,416 | 7/1960 | Snoy | 188/290 X |
| 3,398,551 | 8/1968 | Yannascoli | 417/307 X |
| 3,514,162 | 5/1970 | Erlebach et al. | 303/10 X |

*Primary Examiner*—Duane A. Reger
*Attorney, Agent, or Firm*—Richard E. Jenkins

[57] ABSTRACT

An improved hydraulic valve system particularly adapted for use in a hydraulic circuit of an exercise apparatus in order to more quickly equalize the high and low pressure sides of the hydraulic circuit when a load is removed therefrom. The valve system is adapted to allow the high pressure side after the force has ceased to open a relief valve so as to allow the low pressure side and the reservoir to quickly come into equilibrium with the high pressure side. In this fashion, the tendency of the base line pressure to be elevated during repetitive exercises is obviated and accurate exercise data can be accumulated.

15 Claims, 4 Drawing Figures

VALVE SYSTEM FOR EXERCISE APPARATUS

Technical Field

This invention relates to an improved valve system for an exercise apparatus of the type utilizing a hydraulic pump which is actuated by the user of the apparatus in order to exercise certain portions of the body. The valve system allows for quick equalization of the high side and low side pressure of the hydraulic system when the user ceases to exert a force on the hydraulic pump. This is desirable since any significant delay in equalization can result in difficulties in evaluating the user's performance.

BACKGROUND ART

Heretofore exercise apparatus utilizing a hydraulic pump in a closed hydraulic circuit in order to provide resistance to movement have tended to require an unsatisfactorily long period of time in order to achieve equalization of hydraulic pressure on the high and low side of the pump when the user ceases to exert a force thereon. This is believed to be due primarily to the fact that hydraulic fluid has been trapped between the proportional relief valve of the system used to selectively control the force required to actuate the pump and the check valves provided in the hydraulic circuit in order to control hydraulic fluid flow from one side of the pump to the other during the course of exercise. Therefore, as the user exerts a force and then releases the same, the base pressure of the system tends to increase. This is particularly apparent when the cycles of exercise by the user are rapid and continuous. The result is that the base pressure of the hydraulic circuit tends to increase and thereby create distorted evaluation data of user movement. This was initially overcome by providing a small fluid flow control valve in a bypass circuit around the selectively controlled proportional relief valve in the hydraulic circuit. Although this modification of the hydraulic circuit resulted in evaluation data which more closely reflected actual user exercise, the bypass valve was unable to provide equalization of the high and low pressure side of the hydraulic system when a force was applied in less than one second after removal thereof. Therefore, the improved valve system of the present invention has eliminated the need for the bypass circuit and valve previously utilized and, more importantly, eliminated hydraulic pressure buildup in an exercise apparatus circuit to allow for the accumulation of evaluation data closely reflecting actual user exercise movement.

DISCLOSURE OF THE INVENTION

The valve system of the instant invention provides for an improved valve allowing prompt equalization of the high and low side fluid pressure in the closed hydraulic circuit of an exercise apparatus when a force is removed from the hydraulic pump used to create resistance to user movement. This is accomplished by providing a hydraulic valve system which utilizes the relatively high pressure side of the hydraulic system to open a relief port within the valve system in order to allow the low pressure side and reservoir of the hydraulic circuit to come into fluid communication. In this fashion, the hydraulic valve system prevents elevation or "pumping up" of the base pressure and the distorted user exercise evaluation data which may result therefrom when rapid cyclical movements are made on an exercise apparatus.

It is therefore a primary object of this invention to provide an improved hydraulic valve system particularly adapted for quick equalization of the high and low side pressure of the closed hydraulic circuit of an exercise apparatus after a force is removed therefrom.

It is a more specific object of the invention to provide a hydraulic valve system particularly suited for use in an exercise apparatus of the type utilizing a closed hydraulic circuit in order to accumulate more accurate evaluation data than has heretofore been possible

DESCRIPTION OF THE DRAWINGS

Some of the objects of the invention having been stated, other objects will become evident as the description proceeds, when taken in connection with the accompanying drawings, in which.

BEST MODE FOR CARRYING OUT THE INVENTION

Figure 1:
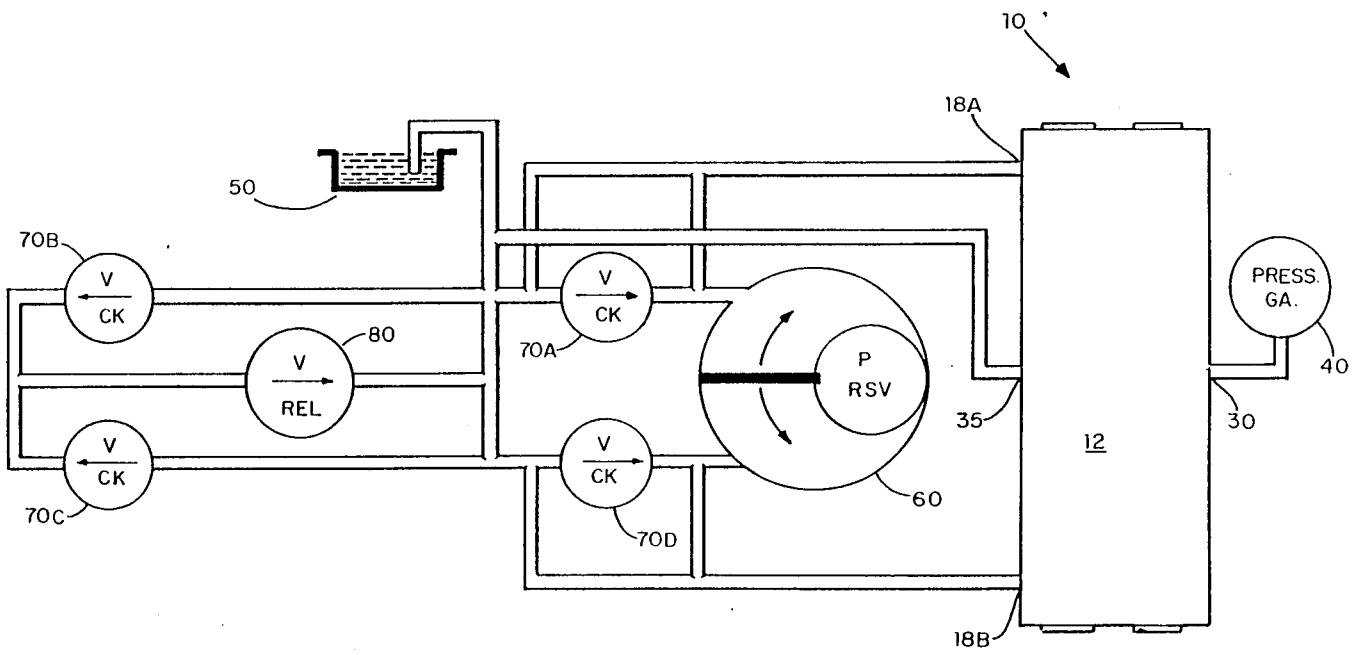
FIG. 1 is a schematic drawing of the valve system of the instant invention positioned in a typical hydraulic circuit utilized by certain exercise apparatus.
Figure 2:
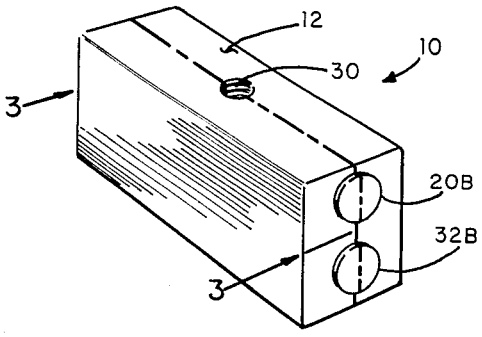
FIG. 2 is a perspective view of the hydraulic valve system of the instant invention.
Figure 2A:
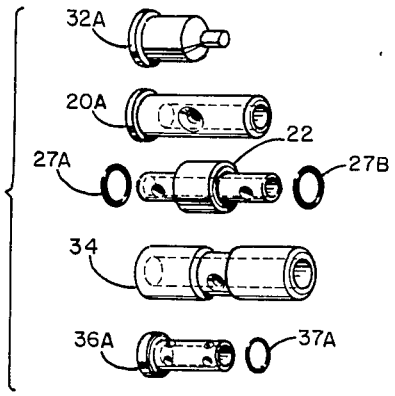
FIG. 2A depicts representative components contained within the housing of the valve system of the instant invention.
Figure 3:
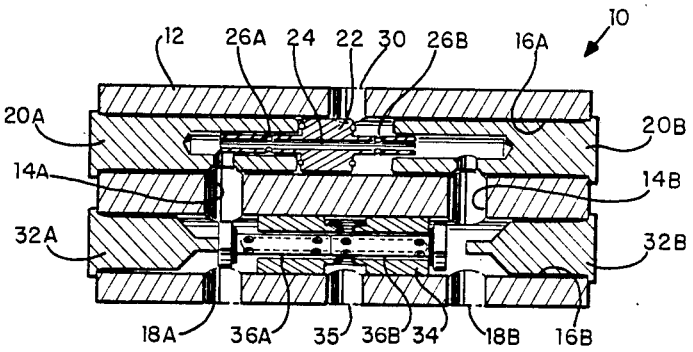
FIG. 3 is a vertical cross sectional view of the valve system of the instant invention taken in the direction of lines 3—3 of FIG. 2.

Referring now more specifically to the drawings, FIGS. 1-3 depict the hydraulic valve system of the present invention which is generally designated 10 therein. With reference to FIGS. 2 and 3, valve system 10 comprises a housing 12 defining vertical passageways 14A, 14B and horizontal passageways 16A, 16B therein. Vertical passageways 14A, 14B intersect with both horizontal passageways 16A, 16B and terminate at one end thereof into horizontal passageway 16A. The other end of vertical passageways 14A, 14B define fluid flow ports 18A, 18B, respectively. Fluid ports 18A, 18B fluidly communicate with the respective sides of a closed hydraulic system of the type associated with an exercise machine. With reference again to housing 12, it can be seen that horizontal passageway 16A is closed at opposing ends thereof with plugs 20A, 20B which fluidly communicate with vertical passageways 14A, 14B, respectively, and provide a fluid flow path therefrom into horizontal passageway 16A. Slidably positioned between plugs 20A, 20B is shuttle valve 22. Shuttle valve 22 comprises reduced diameter extensions from the opposing ends of the main portion thereof which are adapted to slidably extend within the flow channels defined by plugs 20A, 20B, respectively. Shuttle valve 22 defines a central aperture 24 extending through the horizontal axis thereof and cross drilled apertures 26A, 26B within the reduced diameter extensions thereof. In this fashion, when one side or vertical passageway of the valve system is subjected to relatively high fluid pressure, vertical passageway 14B for example, shuttle valve 22 will be shifted laterally by the high pressure and toward the low pressure side of the system (see FIG. 3). The high pressure fluid will then travel through vertical passageway 14B and the flow channel defined by plug 20B through pathway 24 within shuttle valve 22 and through aperture 26B out a fluidly communicating pressure gauge port 30. A portion of the high pressure fluid will also continue through aperture 24 defined within shuttle valve 22 to vertical passageway 14A of the low pressure side of the system. O rings 27A, 27B are provided adjacent the shoulders of shuttle valve 22 to facilitate the functioning thereof.

With further reference to housing 12, it should be appreciated that horizontal passageway 16B is closed at opposing ends thereof with sealing plugs 32A, 32B. Fixedly secured between sealing plugs 32A, 32B in passageway 16B is valve seat 34 which defines a reduced diameter medial portion having cross-drilled apertures therein so as to be in fluid communication with reservoir port 35. Slidably and abuttably positioned in valve seat 34 are valves 36A, 36B. Valves 36A, 36B each have an enlarged head on remotely opposing ends thereof and each defines a central fluid pathway extending from adjacent the closed head portion along the horizontal axis to the open other end thereof. Valves 36A, 36B furthermore each defines a plurality of cross-drilled apertures therein with the first set of the apertures positioned adjacent the top portion of the valve and the second set of apertures positioned adjacent the bottom end of the valve. Moreover, it should be appreciated that valves 36A, 36B are of a size relative to valve seat 34 so that when either valve 36A, 36B is slidably pushed inwardly towards valve seat 34 until the head portion thereof contacts said valve seat, the abuttingly contacting other of said valves is partially pushed from valve seat 34 so that the apertures adjacent the top portion thereof are in fluid communication with passageway 16B. Moreover, when valves 36A, 36B are so positioned, the bottom apertures of the inwardly positioned valve are in fluid communication with the apertures defined in the medial portion of valve seat 34. In this fashion, fluid may flow as needed from and to reservoir port 35 through the medial apertures of valve seat 34 and the bottom end apertures of the closed valve through the flow pathway of the open valve and the top end apertures thereof which are in fluid communication with horizontal passageway 16B. O rings 37A, 37B are provided under heads of valves 36A, 36B, respectively, to facilitate sealing contact with valve seat 34.

For further clarity of understanding, it should be appreciated that when high pressure is applied to one side of valve system 10, for example vertical passageway 14B, valve 36B will be forced closed and abutting valve 36A on the low side of the system forced open. While valve 36A is open, low side vertical passageway 14A and reservoir port 35 are in fluid communication through open valve 36A and the lower end apertures of closed valve 36B which are in fluid communication with the medial apertures of valve seat 34. Therefore, in this instance, the fluid pathway should be understood to be from low side vertical passageway 14A and the low side of horizontal passageway 16B through the top apertures of open valve 36A and therethrough into the flow pathway of closed valve 36B. From 36B the flow path extends through the low end apertures of valve 36B which are in fluid communication with the medial apertures of valve seat 34 and reservoir port 35. As can now be fully appreciated, when the force is removed from the high side of the system, it tends to become the relative low pressure side and valves 36A, 36B laterally shift in order to help equalize the pressure between the new high side and the new low side and reservoir. It has been found that this can be accomplished in about 30 to 40 milliseconds so that rapid cyclical exercises may be performed on an apparatus hydraulically associated with the valve system and valid and accurate performance data collected therefrom in view of the improved pressure versus torque relationship of the collected data.

Now, with reference most particularly to FIG. 1 of the drawings, a representative associated hydraulic circuit may be observed. It should be understood that this circuit is only representational, and it is contemplated that valve system 10 may be utilized in association with a wide variety of closed hydraulic circuits in an exercise apparatus. The hydraulic circuit depicted in FIG. 1 includes a pressure gauge 40, most suitably a pressure transducer, in fluid communication with pressure gauge port 30. A fluid reservoir 50 is provided in fluid communication with reservoir port 35. The hydraulic circuit is connected at ports 18A, 18B and comprises a pump 60, most suitably a rotary hydraulic pump, having input and output ports which may be reversed according to the direction of force applied to pump 60. Conventional check valves 70A–70D are provided in a conventional configuration so as to route hydraulic fluid flow from pump 60 through a proportional valve control 80, most suitably a proportional electric valve, for selectively determining the force required to actuate pump 60. The fluid flow path most simply is from the high pressure side of pump 60 through proportional valve 80 to the low pressure side of pump 60. An additional fluid circuit is provided between the high and low pressure sides and includes valve system 10 for quickly equalizing pressure between the sides when a force being applied to pump 60 ceases. This provides for the ability to collect more accurate data from an exercise apparatus in order to better evaluate the performance of the user.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus.

What is claimed is:

1. A hydraulic valve system adapted for quick equalization of high and low pressure in the closed hydraulic circuit of an exercise apparatus when a load is removed, said hydraulic valve system comprising:

a housing defining first and second vertical fluid passageways and first and second intersecting horizontal passageways communicating therewith;

first and second hydraulic circuit connection ports in fluid communication with said first and second vertical fluid passageways, respectively;

a hydraulic pressure gauge port in fluid communication with said first horizontal passageway through an aperture defined by said horizontal passageway;

shuttle valve means operably positioned in said first horizontal passageway between said vertical passageways for opening said normally closed first horizontal passageway aperture in response to high pressure on either side thereof, said shuttle valve means also adapted to allow fluid flow therethrough from the high pressure side to the low pressure side thereof;

a hydraulic reservoir port in fluid communication with said second horizontal passageway through an aperture defined by said second horizontal passageway;

a valve seat fixedly positioned in said second horizontal passageway between said intersecting vertical passageways and in fluid communication with said hydraulic reservoir port; and a pair of valves positioned in horizontally opposing relationship and cooperatively engaging said valve seat so as to provide fluid communication between the low pressure side of said valve seat and said fourth hydraulic port while simultaneously preventing fluid communication between the high pressure side of said valve seat and said fourth hydraulic port.

2. A hydraulic valve according to claim 1 including a hydraulic pressure gauge in fluid communication with said hydraulic pressure gauge port.

3. A hydraulic valve according to claim 2 wherein said hydraulic pressure gauge is a pressure transducer.

4. A hydraulic valve according to claim 1 including a reservoir in fluid communication with said hydraulic reservoir port.

5. A hydraulic valve according to claim 1 wherein a closed hydraulic circuit of an exercise apparatus is in fluid communication with said first and second hydraulic circuit connection ports and comprises:

a hydraulic pump;

a valve for selectively controlling the force required to actuate said hydraulic pump; and check valve means for controlling the pathway of hydraulic fluid in said hydraulic circuit.

6. A hydraulic valve according to claim 5 wherein said hydraulic pump comprises a rotary pump for displaceing hydraulic fluid from a first chamber to a second chamber thereof.

7. A hydraulic valve according to claim 6 wherein said control valve is a proportional electric valve.

8. A hydraulic valve according to claim 5 including a hydraulic pressure gauge in fluid communication with said hydraulic pressure gauge port.

9. A hydraulic valve according to claim 8 wherein said hydraulic pressure gauge is a pressure transducer.

10. A hydraulic valve according to claim 5 including a reservoir in fluid communication with said hydraulic reservoir port.

11. In an exercise apparatus of the type characterized by a hydraulic pump in fluid connection with a closed hydraulic circuit, a hydraulic valve system adapted for quick equalization of high and low side fluid pressure and comprising:

a housing defining first and second vertical fluid passageways and first and second intersecting horizontal passageways communicating therewith;

first and second hydraulic circuit connection ports in fluid communication with said first and second vertical fluid passageways, respectively;

a hydraulic pressure gauge port in fluid communication with said first horizontal passageway through an aperture defined by said horizontal passageway;

shuttle valve means operably positioned in said first horizontal passageway between said vertical passageways for opening said normally closed first horizontal passageway aperture in response to high pressure on either side thereof, said shuttle valve means also adapted to allow fluid flow therethrough from the high pressure side to the low pressure side thereof;

a hydraulic reservoir port in fluid communication with said second horizontal passageway through an aperture defined by said second horizontal passageway;

a valve seat fixedly positioned in said second horizontal passageway between said intersecting vertical passageways and in fluid communication with said hydraulic reservoir port; and a pair of valves positioned in horizontally opposing relationship and cooperatively engaging said valve seat so as to provide fluid communication between the low pressure side of said valve seat and said fourth hydraulic port while simultaneously preventing fluid communication between the high pressure side of said valve seat and said fourth hydraulic port.

12. An exercise apparatus according to claim 11 including a hydraulic pressure gauge in fluid communication with said hydraulic pressure gauge port.

13. An exercise apparatus according to claim 12 wherein said hydraulic pressure gauge is a pressure transducer.

14. An exercise apparatus according to claim 11 including a reservoir in fluid communication with said hydraulic reservoir port.

15. An exercise apparatus according to claim 11 wherein said hydraulic circuit comprises a proportional valve to selectively control the force required to actuate said hydraulic pump.

* * * * *